US007823927B2

(12) United States Patent
Hoarau et al.

(10) Patent No.: US 7,823,927 B2
(45) Date of Patent: Nov. 2, 2010

(54) MEDIA BINDER SYSTEMS WITH DATUM STOPS FOR REGISTERING PHYSICAL MEDIA SHEETS

(75) Inventors: Eric Hoarau, San Francisco, CA (US); Steven W. Trovinger, Los Altos, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 139 days.

(21) Appl. No.: 11/758,432

(22) Filed: Jun. 5, 2007

(65) Prior Publication Data

US 2008/0018090 A1 Jan. 24, 2008

Related U.S. Application Data

(63) Continuation-in-part of application No. 11/490,687, filed on Jul. 21, 2006.

(51) Int. Cl.

| | |
|---|---|
| ***B42D 1/00*** | (2006.01) |
| ***A44B 1/04*** | (2006.01) |
| ***A44B 11/25*** | (2006.01) |
| ***A44B 17/00*** | (2006.01) |
| ***B42F 1/02*** | (2006.01) |
| ***B42F 1/00*** | (2006.01) |
| ***B42F 1/06*** | (2006.01) |
| ***B42F 1/08*** | (2006.01) |
| ***B42F 3/00*** | (2006.01) |
| ***B42F 13/12*** | (2006.01) |
| ***A41F 1/00*** | (2006.01) |
| ***A41F 1/08*** | (2006.01) |

(52) U.S. Cl. ..... 281/21.1; 24/67.9; 24/545; 24/555; 24/563; 402/70; 402/73; 402/500

(58) Field of Classification Search ..... 281/21.1, 281/15.1; 402/70, 73, 500, 502; 24/67.9, 24/545, 555, 563, 456
See application file for complete search history.

(56) References Cited

U.S. PATENT DOCUMENTS 475,425 A 5/1892 Vawter (Continued)

FOREIGN PATENT DOCUMENTS

CA 2050244 3/1992

(Continued)

OTHER PUBLICATIONS

"Fastback Hardcover Guide" et al., Powis Parker Inc., 9 pages, http://www.powis.com (downloaded May 2007).

(Continued)

*Primary Examiner*—Dana Ross
*Assistant Examiner*—Kyle Grabowski

(57) ABSTRACT

Media binder systems with datum stops for registering physical media sheets are described. A media binder system that includes a cover, a binding system, and a datum stop. The cover includes an outwardly facing side and an inwardly facing side. The binding system is attached to the inwardly facing side of the cover and is operable to bind a spine end of a collection of physical media sheets to the cover. The datum stop protrudes away from the inwardly facing side of the cover and includes a datum stop surface against which a head end or a tail end of the collection is registerable prior to binding the collection to the cover. Methods of making media binder systems also are described.

27 Claims, 12 Drawing Sheets

U.S. PATENT DOCUMENTS

| | | | | |
|---|---|---|---|---|
| 560,353 | A | | 5/1896 | Haarvig |
| 1,741,909 | A | | 12/1929 | Belohlavek |
| 2,347,278 | A | | 4/1944 | Fitt |
| 3,957,287 | A | * | 5/1976 | Hall et al. ..... 281/21.1 |
| 4,114,240 | A | | 9/1978 | Nackenson |
| 4,178,201 | A | * | 12/1979 | Power et al. ..... 156/499 |
| 4,402,530 | A | | 9/1983 | Daguerre |
| 4,624,480 | A | | 11/1986 | Marthaler et al. |
| 4,832,369 | A | | 5/1989 | Johnson et al. |
| 4,832,371 | A | | 5/1989 | Mugnai |
| 4,986,713 | A | | 1/1991 | Zoltner et al. |
| 5,015,115 | A | | 5/1991 | Mondolesi |
| 5,035,447 | A | | 7/1991 | Lolli |
| 5,061,139 | A | | 10/1991 | Zoltner |
| 5,066,182 | A | | 11/1991 | Stonebraker et al. |
| 5,156,419 | A | | 10/1992 | Minch |
| 5,314,283 | A | | 5/1994 | Zoltner |
| 5,330,229 | A | | 7/1994 | Zoltner |
| 5,562,309 | A | | 10/1996 | Brink et al. |
| 5,574,519 | A | | 11/1996 | Manico et al. |
| 5,685,530 | A | | 11/1997 | DeLisa |
| 5,697,131 | A | | 12/1997 | Hunt |
| 5,716,181 | A | | 2/1998 | Ebel |
| 5,733,087 | A | | 3/1998 | Gwyn |
| 5,873,601 | A | | 2/1999 | Peleman |
| 5,938,241 | A | | 8/1999 | Wilson |
| 5,941,569 | A | | 8/1999 | Solomons |
| 5,944,353 | A | | 8/1999 | Sato |
| 6,149,200 | A | | 11/2000 | Lockhart |
| 6,155,763 | A | | 12/2000 | Parker et al. |
| 6,322,867 | B1 | | 11/2001 | Rush et al. |
| 6,340,178 | B1 | | 1/2002 | Nkanishi et al. |
| 6,422,797 | B2 | | 7/2002 | Pas |
| 6,428,260 | B1 | | 8/2002 | Parker |
| 6,581,970 | B1 | | 6/2003 | Lein |
| 6,599,073 | B1 | | 7/2003 | Hartwig et al. |
| 6,672,815 | B2 | | 1/2004 | Parker et al. |
| 6,685,415 | B2 | | 2/2004 | Rush et al. |
| 6,709,727 | B1 | | 3/2004 | Parker |
| 6,726,423 | B2 | | 4/2004 | Hocking |
| 6,746,050 | B2 | | 6/2004 | Peleman |
| 6,861,140 | B2 | | 3/2005 | Peleman |
| 7,134,822 | B2 | | 11/2006 | Parker et al. |
| 7,153,076 | B2 | | 12/2006 | Parker et al. |
| 2006/0061085 | A1 | | 3/2006 | Feleman |

FOREIGN PATENT DOCUMENTS

| | | |
|---|---|---|
| FR | 792956 | 4/1959 |
| GB | 620201 | 3/1949 |
| GB | 2145033 | 3/1985 |
| GB | 2266866 | 11/1993 |
| GB | 2294903 | 5/1996 |
| JP | 09-216477 | 8/1997 |
| KR | 2006-0051403 | 5/2006 |
| WO | WO 9717221 | 5/1997 |
| WO | WO 03043834 | 5/2003 |

OTHER PUBLICATIONS

"High Quality Presentation Covers" et al.,Channelbind International Corp., 5 pages, http://www.channelbind.com (downloaded May 2007).

"Binding on demand," Unibind Corp., 2 pages, http://www.unibind.com/Basic/binding/steelbinding/photobook.html (downloaded May 2007).

PCT Search Report issued in PCT/US2008/006769 on May 28, 2008.

* cited by examiner

MEDIA BINDER SYSTEMS WITH DATUM STOPS FOR REGISTERING PHYSICAL MEDIA SHEETS

CROSS-REFERENCE TO RELATED APPLICATIONS

This application is a continuation-in-part of copending U.S. application Ser. No. 11/490,687, filed Jul. 21, 2006, which is incorporated herein by reference.

This application is related to U.S. application Ser. No. 11/522,626, filed Sep. 18, 2006 and U.S. application Ser. No. 11/681,636, filed Mar. 2, 2007, both of which are incorporated herein by reference.

BACKGROUND

Media binders are used for holding a wide variety of items, including sheets of physical media, such as loose sheets of paper and the like. A media binder typically includes a cover and a binding mechanism for retaining physical media sheets that are inserted in the media binder. Many different binding mechanisms have been used to secure physical media sheets in such media binders. For example, some media binders include a metal channel that is crimped onto the physical media sheets in order to apply a mechanical holding force that retains the physical media sheets within the media binders. Some other media binders include an adhesive, such as a thermally activatable adhesive or a pressure sensitive adhesive, which bonds the physical media sheets within the binders. In some media binders, a front cover and a back cover are attached to opposite sides of one or more spring clamps that are located in the spine of the binder; the front and back covers can be folded back against the sides of the spring clamps, whereby the front and back covers act as levers and the spine acts as a fulcrum in opening the spring clamps to enable items to be inserted between the clamping surfaces of the spring clamps.

It oftentimes is difficult to achieve aesthetically pleasing binding results with the media binders that currently are available. For example, such media binders typically either require the user to position and register the physical media sheets without any guidance before securing the sheets to the media binder or they require a separate bulky alignment apparatus for positioning and registering the sheets within the media binder. As a result, such media binders typically either do not allow the user to achieve aesthetically pleasing binding results or they require the user to use a cumbersome alignment apparatus. Therefore, what are needed are media binders that provide aesthetically pleasing binding results with an intuitive and easy-to-use binding process.

SUMMARY

In one aspect, the invention features a media binder system that includes a cover, a binding system, and a datum stop. The cover includes an outwardly facing side and an inwardly facing side. The binding system is attached to the inwardly facing side of the cover and is operable to bind a spine end of a collection of physical media sheets to the cover. The datum stop protrudes away from the inwardly facing side of the cover and includes a datum stop surface against which a head end or a tail end of the collection is registerable prior to binding the collection to the cover.

In another aspect, the invention features a method in accordance with which a binding system is attached to an inwardly facing side of a cover. The binding system is operable to bind a spine end of a collection of physical media sheets to the cover. The binding system includes a datum stop that protrudes away from the inwardly facing side of the cover. The datum stop includes a datum stop surface against which a head end or a tail end of the collection is registerable prior to binding the collection to the cover.

Other features and advantages of the invention will become apparent from the following description, including the drawings and the claims.

DETAILED DESCRIPTION

In the following description, like reference numbers are used to identify like elements. Furthermore, the drawings are intended to illustrate major features of exemplary embodiments in a diagrammatic manner. The drawings are not intended to depict every feature of actual embodiments nor relative dimensions of the depicted elements, and are not drawn to scale.

I. Introduction

The embodiments that are described herein provide media binders that provide aesthetically pleasing binding results with an intuitive and easy-to-use binding process. These embodiments include a datum stop that provides a datum stop surface against which a collection of physical media sheets is registerable prior binding the collection within the media binder. The datum stop allows users to position and register the physical media sheet collection prior to binding without requiring a separate cumbersome alignment apparatus. In this way, these embodiments enable users to easily achieve aesthetically pleasing binding results.

II. Overview

Figure 1:
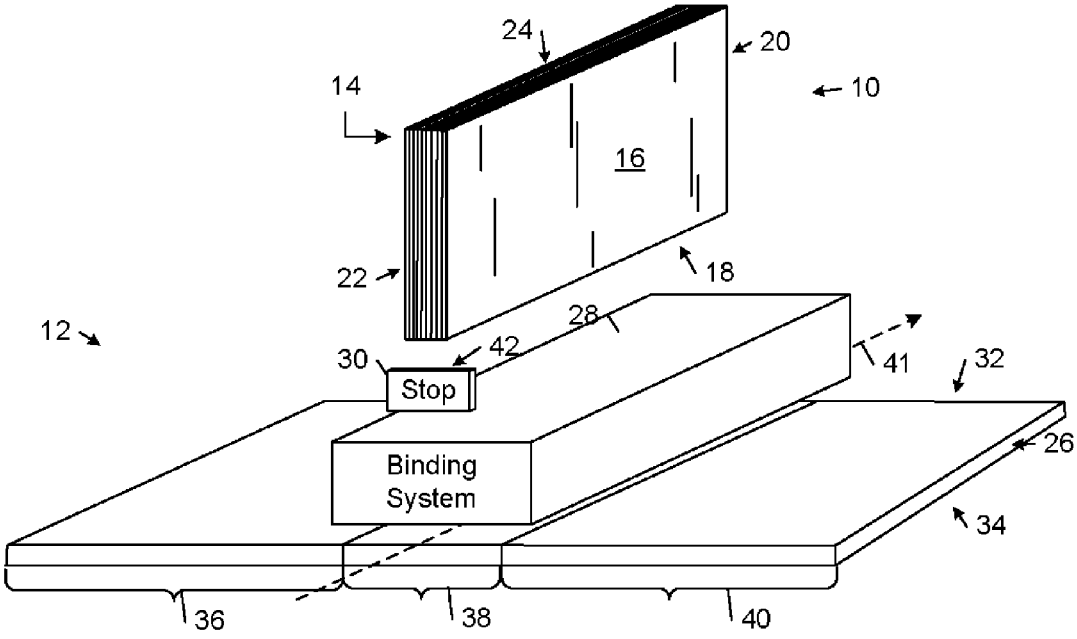
FIG. 1 is an exploded diagrammatic view of an embodiment of a collection of physical media sheets and an embodiment of a media binder that includes a cover, a binding system, and a datum stop.

FIG. 1 shows a perspective view of a collection 10 of physical media sheets (e.g., sheets of paper and the like) and an exploded view of an embodiment of a media binder 12 for holding the collection 10 of physical media sheets.

The physical media sheet collection 10 is characterized by a front face 14, a back face 16, a spine end 18, a head end 20, a tail end 22, and a fore-edge end 24.

The media binder includes a cover 26, a binding system 28, and a datum stop 30.

The cover 26 includes an inwardly facing side 32 an outwardly facing side 34. The cover 26 also includes a front part 36, a spine part 38, and a back part 40. Each of the front, spine, and back parts 36-40 of the cover 26 typically is formed of multiple material layers, including an outer covering layer and discrete front, spine, and back base layers. The outer covering layer typically is formed of a durable material (e.g., a textile). The central region of the outer covering is attached to the outwardly facing surfaces of the front, spine, and back base layers, whereas the marginal edges of the outer covering layer typically are folded over the side edges of the base layers and attached to the inwardly facing surfaces of the front, spine, and back base layers. The front, spine, and back base layers typically are formed of a rigid planar material (e.g., paperboard or a stiff polymeric material). In some embodiments, the spine base layer is segmented into multiple sections to facilitate bending during opening and closing of the media binder 12. In other embodiments, the cover 26 is formed of one or more layers of flexible material (e.g., plastic).

In some embodiments, the front part 36 of the cover 26 includes an optional window that allows users to see an image on the first front facing one of the physical media sheets of the collection 10 after it is loaded into the media binder 12. Some embodiments include an optional protective sheet that is affixed to the front base layer. In general, the protective sheet may be formed of a wide variety of different materials, including an acetate material, a single or composite polymeric film, or vellum. The protective sheet typically is made of a transparent material in embodiments in which the window is present. A decorative front pastedown sheet typically is attached to the inwardly facing surface of the front base layer over the frontside marginal edges of the outer covering layer and over a folded down edge of the protective sheet (if present). A decorative back pastedown sheet also typically is attached to the inwardly facing surface of the back base layer over the backside marginal edges of the outer covering layer.

The binding system 28 is attached to the inwardly facing side 32 of the cover 26. The binding system 28 is operable to bind the collection 10 of physical media sheets to the cover 26. The binding system 28 may be implemented in a wide variety of different ways, including but not limited to all the ways described in detail below an in U.S. application Ser. No. 11/490,687, filed Jul. 21, 2006, U.S. application Ser. No. 11/522,626, filed Sep. 18, 2006, and U.S. application Ser. No. 11/681,636, filed Mar. 2, 2007. The binding system 28 typically includes at least one component that extends in a spinal direction 41 along the inwardly facing side of the spine part 38 of the cover 26.

The datum stop 30 protrudes away from the inwardly facing side 32 of the cover 26 and includes a datum stop surface 42 against which the collection 10 of physical media sheets is registerable prior to binding the collection 10 to the cover 26. The datum stop 30 typically protrudes in a direction orthogonal to the spinal direction 41. The datum stop surface 42 typically is orthogonal to the inwardly facing side 32 of the cover 26. The datum stop 30 typically is disposed at a distal end of the spine part 38 of the cover 26. The datum stop surface 42 provides an edge against which the head end 20 or the tail end 22 of the collection 10 of physical media sheets may be registered to achieve an aesthetically pleasing binding of the physical media sheets with aligned edges. In some embodiments, a second datum stop is provided at the opposite end of the spine part 38 of the cover 26. The datum stop 30 typically is formed of a rigid material (e.g., a rigid plastic or metal material). In some embodiments, the datum stop 30 is attached to the media binder 12 by a breakable link that allows the user to detach the datum stop 30 from the media binder after the collection 10 of physical medial sheets have been secured to the cover 26.

In some embodiments the datum stop 30 protrudes from a component of the binding system 28. In these embodiments, the datum stop 30 may be a separate and discrete component that is attached to the binding system 28 using, for example, an adhesive or a mechanical attachment mechanism; alternatively, the datum stop 30 may be part of a component of the binding system 28—for example, the datum stop 30 and the binding system component may be integral components of a single stamped metal part or a single molded plastic part. In other embodiments, the datum stop 30 protrudes from a region of the spine part 38 of the cover 26 adjacent the binding system 28.

In other embodiments, the datum stop 30 is an integral component of a datum bar that includes a spacer that extends in the spinal direction 41 along the spine part 38 of the cover 26. The spacer typically has a planar datum surface against which the spine end 18 of the collection 10 of physical media sheets may be registered so that the fore-edge end 24 of the sheets present a clean edge to the user. The datum surface of the spacer also sets the height of the physical media sheet collection 10 above the spine part 38 of the cover 26. In this way, the spacer datum surface limits the insertion depth of physical media sheets into the spine of the media binder and, thereby, reduces the marginal portions of the physical media sheets that otherwise might be obscured by the sheet retention mechanism of the binding system 28. In this regard, the spacer has a thickness that positions the spacer datum surface a desired height above the spine part 38 of the cover 26. In some embodiments, the spacer has tapered side walls as described in U.S. application Ser. No. 11/681,636, filed Mar. 2, 2007.

In some embodiments, the cover 26, the binding system 28, and the datum stop 30 are sold preassembled into the media binder 12. In other embodiments, the cover 26, the binding system 28, and the datum stop 30 are sold as a kit in which one or more of these components must be combined with the other components to form the media binder 12.

III. Exemplary Media Binder System Embodiments

A. Media Binder Systems that Include Trough-Based Cover Binding Systems

Some embodiments of the media binder 12 have cover binding systems that include a trough for receiving the spine end 18 of the collection 10 of physical media sheets and providing a support structure that shapes the spine of the media binder 12.

1. Binding Systems Having Mechanical Sheet Retention Systems

Figure 2:
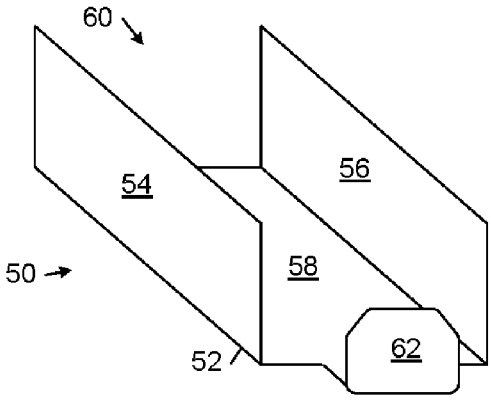
FIG. 2 is a perspective view of an embodiment of an elongated body that defines a trough and includes an integral datum stop.

FIG. 2 shows an embodiment 50 of the binding system 28 that includes an elongated body 52. The elongated body 52 includes a front side wall 54, a back side wall 56, and a spinal side wall 58 whose inner surfaces collectively define a trough 60. The elongated body 52 also includes an embodiment 62 of the datum stop 30. In the illustrated embodiment, the elongated body 52 and the datum stop 62 are formed of a single piece of an inelastically deformable material (e.g., a stamped metal piece).

Figure 3:
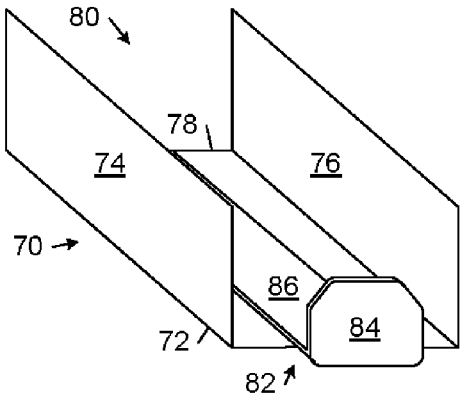
FIG. 3 is a perspective view of an embodiment of an elongated body that defines a trough containing a datum bar with an integral datum stop.

FIG. 3 shows an embodiment 70 of the binding system 28 that includes an elongated body 72. The elongated body 72 includes a front side wall 74, a back side wall 76, and a spinal side wall 78 whose inner surfaces collectively define a trough 80. The binding system 70 also includes a datum bar 82 that includes an embodiment 84 of the datum stop 30 and a spacer 86. The datum stop 84 and the spacer 86 typically are formed of a single piece of material (e.g., metal or plastic). In the illustrated embodiment, the elongated body 72 is formed of a single piece of an inelastically deformable material (e.g., a stamped piece of metal, such as steel). The datum bar 82 and the elongated body 72 are attached to one another using, for example, an adhesive or a mechanical attachment mechanism.

Figure 4A:
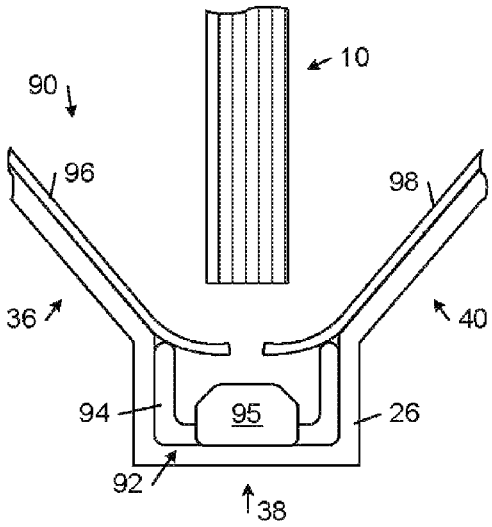
FIG. 4A is a side view of an embodiment of the media binder of FIG. 1 that has a binding system that includes an elongated body of the type shown in FIGS. 2 and 3.

FIG. 4A shows an embodiment 90 of the media binder 12 that includes a binding system 92 of the type shown in FIGS. 2 and 3 that includes an elongated body 94, which is formed of an inelastically deformable material, and a datum stop 95. The binding system 92 is attached to the inwardly facing side of the spine part 38 of the cover 26 using, for example, an adhesive or a mechanical attachment mechanism. The media binder 90 additionally includes a front pastedown sheet 96 and a back pastedown sheet 98, which extend over the trough defined by the elongated body 94 before the collection 10 of physical media sheets is registered against the datum stop 95 and inserted into the trough.

Figure 4B:
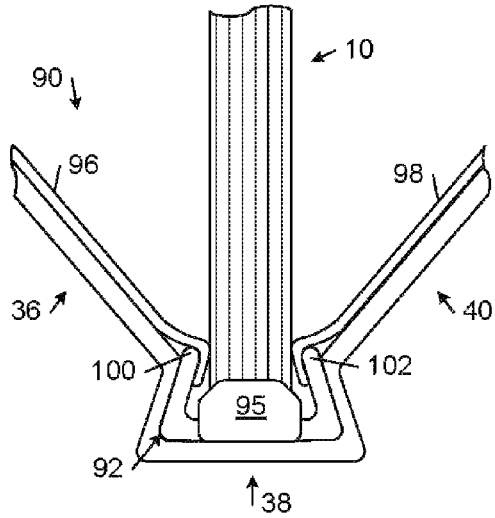
FIG. 4B is a side view of the media binder of FIG. 4A after the elongated body has been crimped onto outer faces of a collection of physical media sheets.

FIG. 4B shows the media binder 90 after terminal sides 100, 102 of the elongated body 94 have been crimped onto outer faces of the collection 10 of physical media sheets. A separate tool (e.g., a binding apparatus of the type described in any of U.S. Pat. Nos. 4,986,713, 5,314,283, and 5,330,229) typically is used to crimp the terminal sides 100, 102 of the elongated body 94. The gripping force that is applied by the terminal sides 100, 102 of the elongated body 94 typically is sufficient to retain the collection 10 of physical media sheets under normal operating conditions.

Figure 5:
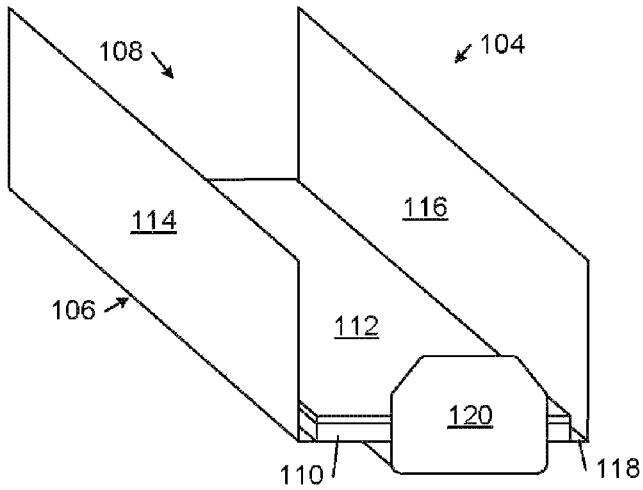
FIG. 5 is a perspective view of an embodiment of a binding system that includes an elongated body that defines a trough containing a pressure sensitive adhesive with an overlying backing.

2. Binding Systems Having Adhesive-Based Sheet Retention Systems a. Binding Systems Having Adhesive in a Central Area of the Spine Part of the Cover FIG. 5 shows an embodiment 104 of the binding system 28 that includes an elongated body 106 that defines a trough 108 containing a pressure sensitive adhesive 110 with an overlying backing 112. The elongated body 106 includes a front side wall 114, a back side wall 116, and a spinal side wall 118 whose inner surfaces collectively define the trough 108. The binding system 104 also includes an embodiment 120 of the datum stop 30. In the illustrated embodiment, the elongated body 106 and the datum stop 120 are formed of a single piece of an inelastically deformable material (e.g., a stamped metal piece). In other embodiments, the datum stop 120 is part of a datum bar of the type shown in FIG. 3, in which the datum stop 120 is formed integrally with a spacer from a single piece of material (e.g., metal or plastic). In the illustrated embodiment, the elongated body 106 is formed of a single piece of a rigid material (e.g., a plastic material or a stamped piece of metal, such as aluminum or stainless steel).

In the illustrated embodiment, pressure sensitive adhesive 110 with the overlying backing 112 is affixed to the inner surface of the spinal side wall of the elongated body 106. In other embodiments, pressure sensitive adhesive with overlying backing may be affixed to the inner surfaces of the front and back side walls 114, 116 of the elongated body instead of or in addition to the pressure sensitive adhesive 110 on the spinal side wall 118. As used herein, a "pressure sensitive adhesive" refers to a class of adhesive compositions that are applied with pressure and generally do not undergo a liquid to solid transition in order to hold materials together. Pressure sensitive adhesives may be solvent-free natural or synthetic resins characterized by the rapid wetting of a surface to form an adhesive bond upon contact with the surface under pressure. The backing overlying the pressure sensitive adhesive typically is formed of paper with a non-stick top surface opposite the surface in contact with the pressure sensitive adhesive.

Figure 6A:
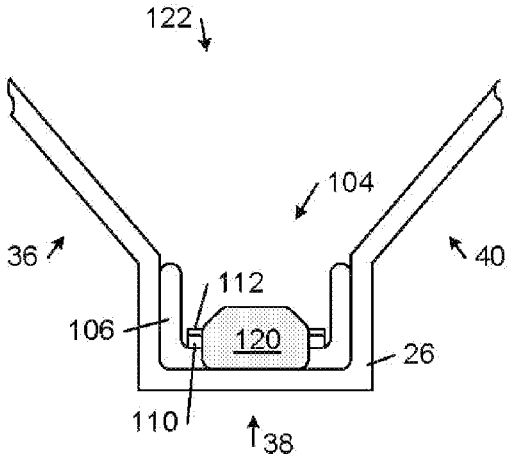
FIG. 6A is a side view of an embodiment of the media binder of FIG. 1 that includes the binding system of FIG. 5.
Figure 6B:
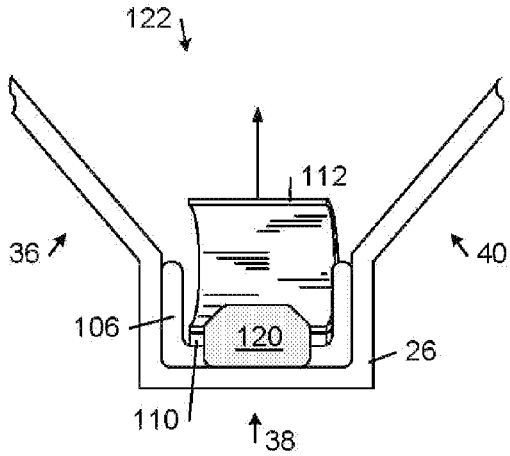
FIG. 6B is a side view of the media binder of FIG. 6A as the backing overlying the pressure sensitive adhesive is being removed.
Figure 6C:
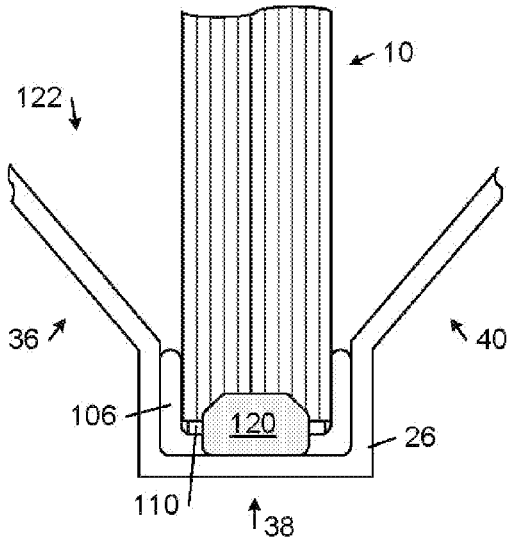
FIG. 6C is a side view of the media binder of FIG. 6A after a collection of physical media sheets has been registered against the datum stop and bound to the cover by the pressure sensitive adhesive.
Figure 7A:
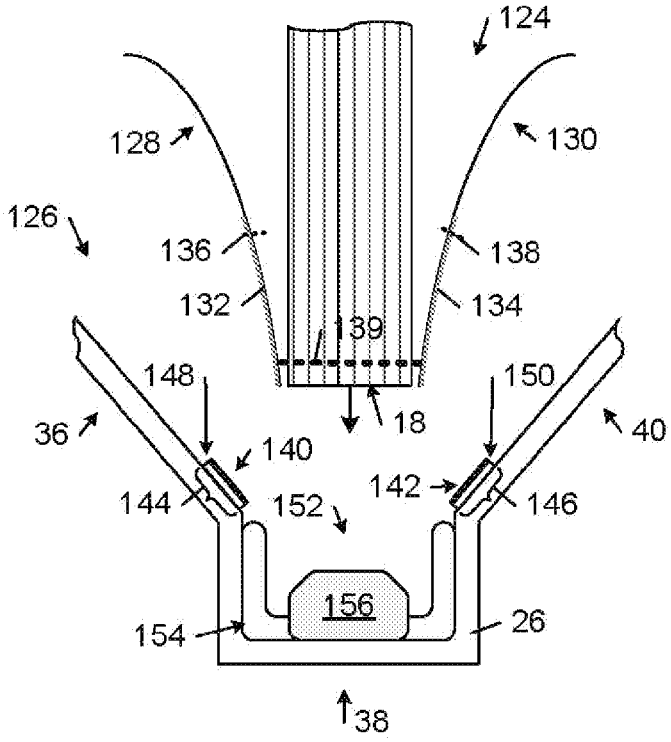
FIG. 7A is a side view of an embodiment of a collection of physical media sheets being loaded into an embodiment of the media binder of FIG. 1 that has a binding system that includes pressure sensitive adhesive on front and back adhesive areas of the inwardly facing front and back parts of the cover.

FIG. 6A shows an embodiment 122 of the media binder 12 that includes the binding system 104 shown in FIG. 5. The binding system 104 is attached to the inwardly facing side of the spine part 38 of the cover 26 using, for example, an adhesive or a mechanical attachment mechanism. FIG. 6B shows the media binder 104 as the backing 112 overlying the pressure sensitive adhesive 110 is being removed by a user. FIG. 6C shows the media binder 104 after the backing 112 has been removed and after the collection 10 of physical media sheets has been registered against the datum stop 120 and bound to the cover 26 by the pressure sensitive adhesive 110.

b. Binding Systems Having Adhesive in Adhesive Areas of the Front and Back Parts of the Cover FIG. 7A shows an embodiment 124 of the collection 10 of physical media sheets being loaded into an embodiment 126 of the media binder 12.

The collection 124 includes front and back end sheets 128, 130. In the illustrated embodiment, each of the front and back end sheets 128, 130 is a physical media sheet (e.g., a paper sheet) that includes a plasticized layer 132, 134 and a tear-line (indicated diagrammatically by the dashed lines 136, 138) that extends in a direction parallel to the spinal direction. In some embodiments, the tear-lines 136, 138 are implemented by tearable perforation lines. In the illustrated embodiment, the collection 124 of physical media sheets, including the end sheets 128, 130, is bound into a book block before it is loaded into the media binder 126. The collection 124 may be bound in a wide variety of different ways, including but not limited to attaching an adhesive binding strip to the spine end 18 of the collection 124 and binding the collection with a mechanical attachment mechanism, such as one or more staples (indicated diagrammatically by the dashed line 139).

The media binder 126 includes pressure sensitive adhesive 140, 142 on front and back adhesive areas 144, 146 of the inwardly facing front and back parts 36, 40 of the cover 26. The tear-lines 136, 138 of the end sheets 128, 130 are spaced from the spine edges of the end sheets 128, 130 by a distance that is at least as far as the distance separating the outer edges 148, 150 of the front and back adhesive areas 144, 146. The media binder 126 also incorporates an embodiment 152 of the binding system 28 of the type shown in FIGS. 2 and 3, which includes an elongated body 154 that defines a trough, and a datum stop 156. In this embodiment, the elongated body 154 and the datum stop 156 may be formed of any type of rigid material, including but not limited to metal and plastic. In addition, the elongated body 154 and the datum stop 156 may be integral parts of a single material piece or they may be discrete parts that are mechanically or adhesively attached to one another.

Figure 7B:
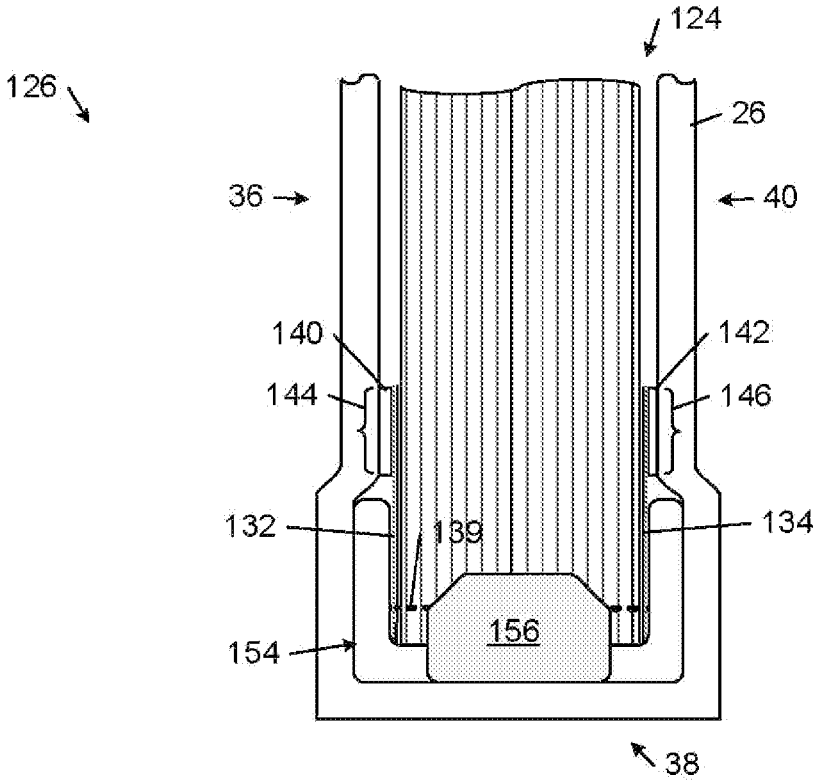
FIG. 7B is a side view of the media binder of FIG. 7A after the collection of physical media sheets has been bound to the cover by the pressure sensitive adhesive.

FIG. 7B shows the media binder 126 after the bound collection 124 of physical media sheets has been registered against the datum stop 156 and then attached to the cover 26 by the pressure sensitive adhesive 140, 142. As shown in FIG. 7B, after the collection 124 is secured to the cover 26, the fore-edge portions of the end sheets 128, 130 may be removed by tearing the ends sheets 128, 130 along the tear-lines 136, 138.

c. Binding Systems Having Adhesive in Side Areas of the Spine Part of the Cover

Figure 8:
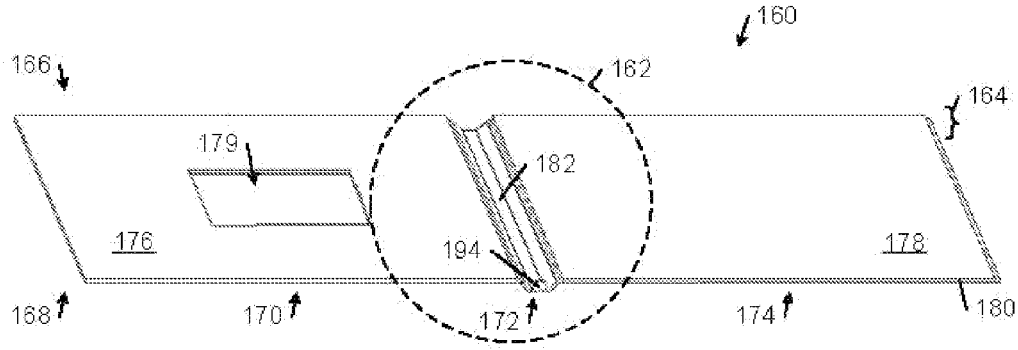
FIG. 8 is a perspective view of an embodiment of the media binder of FIG. 1 in an open state.
Figure 9A:
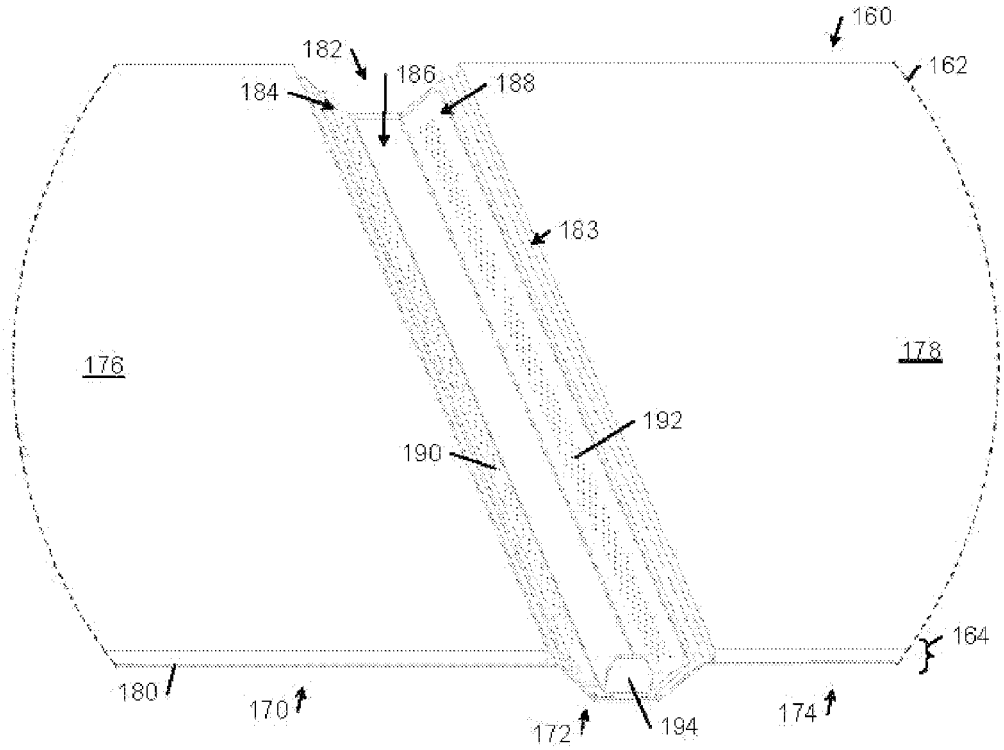
FIG. 9A is an enlarged perspective view of a region of the media binder of FIG. 8 in the open state.

FIG. 8 shows an embodiment 160 of the media binder 10 in an open state. FIG. 9A shows an enlarged view of a central region 162 of the media binder 160. The media binder 160 includes a cover 164 that has an inwardly facing side 166 an outwardly facing side 168. The cover 160 also includes a front part 170, a spine part 172, and a back part 174. The front and back parts 170, 174 of the cover 164 respectively include front and back base layers 176, 178. The front base layer 176 includes a window 179 that allows users to see an image on the first front facing one of the physical media sheets of the collection 10 after it is loaded into the media binder 160. The front and back base layers 176, 178 are attached to an outer covering 180, which is formed of a durable material (e.g., a textile). The central region of the outer covering 180 is attached to the outwardly facing surfaces of the front and back base layers 176, 178; the marginal edges of the outer covering 180 are folded over the side edges of the front and back base layers 176, 178 and attached to the inwardly facing surfaces of the front and back base layers 176, 178. The front and back base layers 176, 178 typically are formed of a rigid planar material (e.g., paperboard or a stiff polymeric material).

In the illustrated embodiment, a binding system 182 is attached to the outer covering 180 in the spine part 172 of the cover 164. The binding system 182 includes an elongated body 183 that has a front side wall 184, a spinal side wall 186, and a back side wall 188 that together define a trough for receiving the collection 10 of physical media sheets. Pressure sensitive adhesive 190, 192 is located on the front side wall 184 and the back side wall 188. The pressure sensitive adhesive 190, 192 is capable of binding front and back faces of the collection 10 of physical media sheets to the elongated body 183. The pressure sensitive adhesive 190, 192 typically is covered by an overlying backing before the collection 10 is loaded into the media binder 160. In some embodiments, the pressure sensitive adhesive is applied to only one of the front side wall 184 and the back side wall 188. The binding system 182 additionally includes a datum stop 194. In this embodiment, the elongated body 183 and the datum stop 194 may be formed of any type of rigid material, including but not limited to metal and plastic. In addition, the elongated body 183 and the datum stop 194 may be integral parts of a single material piece or they may be discrete parts that are mechanically or adhesively attached to one another.

Figure 9B:
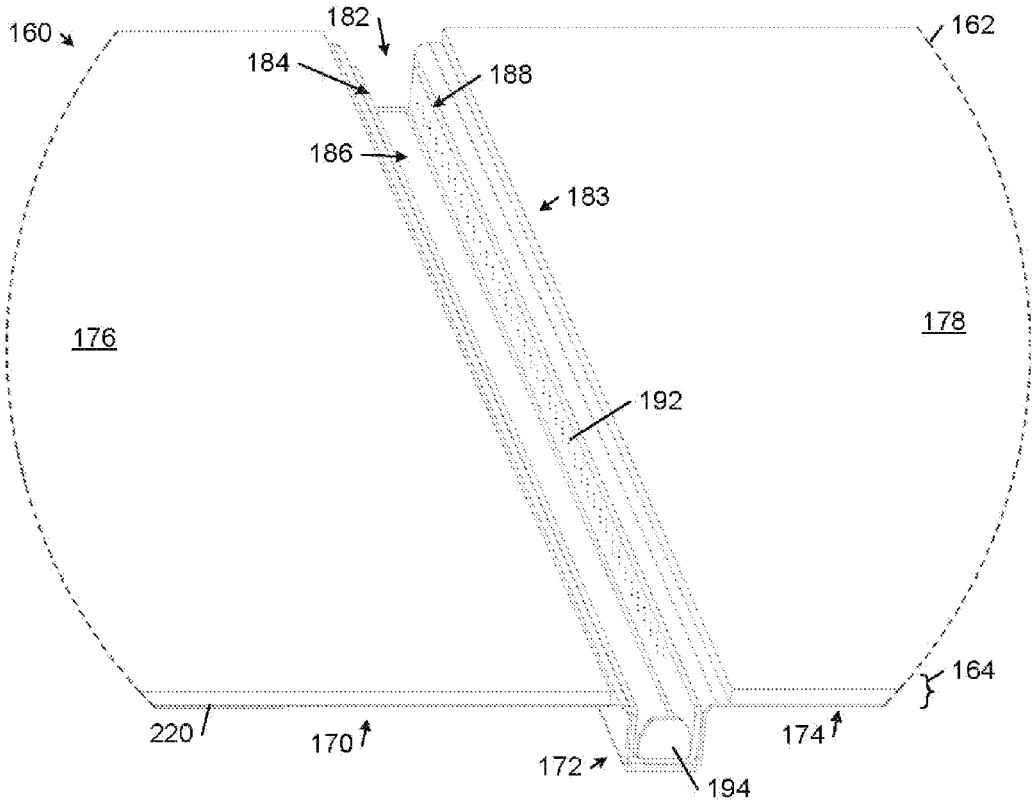
FIG. 9B is an enlarged perspective view of a region of the media binder of FIG. 8 in a closed state.

Referring to FIGS. 9A and 9B, the front and back side walls 184, 188 of the elongated body 182 are bendable with respect to the spinal side wall 186 between the open state shown in FIG. 9A, in which the elongated body 182 presents an enlarged opening for receiving the collection 10 of physical media sheets, and the closed state shown in FIG. 9B, in which the elongated body 182 defines the trough around the spine end 18 of the collection 10. In the process of binding the collection 10 of physical media sheets, a user registers the collection against the datum stop 194 and the spinal side wall 186. After removing the backing overlying the pressure sensitive adhesive 190, 192, the user bends the front and back side walls 184, 186 along lines of preferential bending between the spinal side wall 186 and each of the front and back side walls 184, 188 until the pressure sensitive adhesive 190, 192 contacts the front and back faces 14, 16 of the collection. The lines of preferential bending may be implemented by an indentation, a crease, or score line that facilitates bending of the elongated body 182 along the parallel intersections between the spinal side wall 186 and each of the front and back side walls 184, 188.

Figure 10:
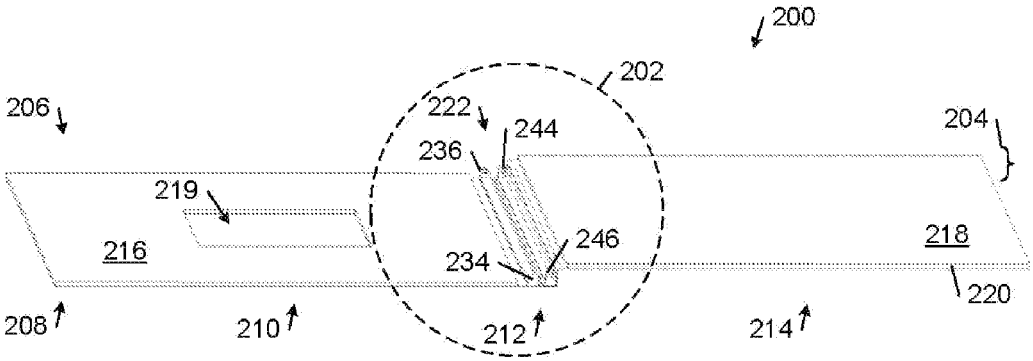
FIG. 10 is a perspective view of an embodiment of the media binder of FIG. 1 in an open state.
Figure 11A:
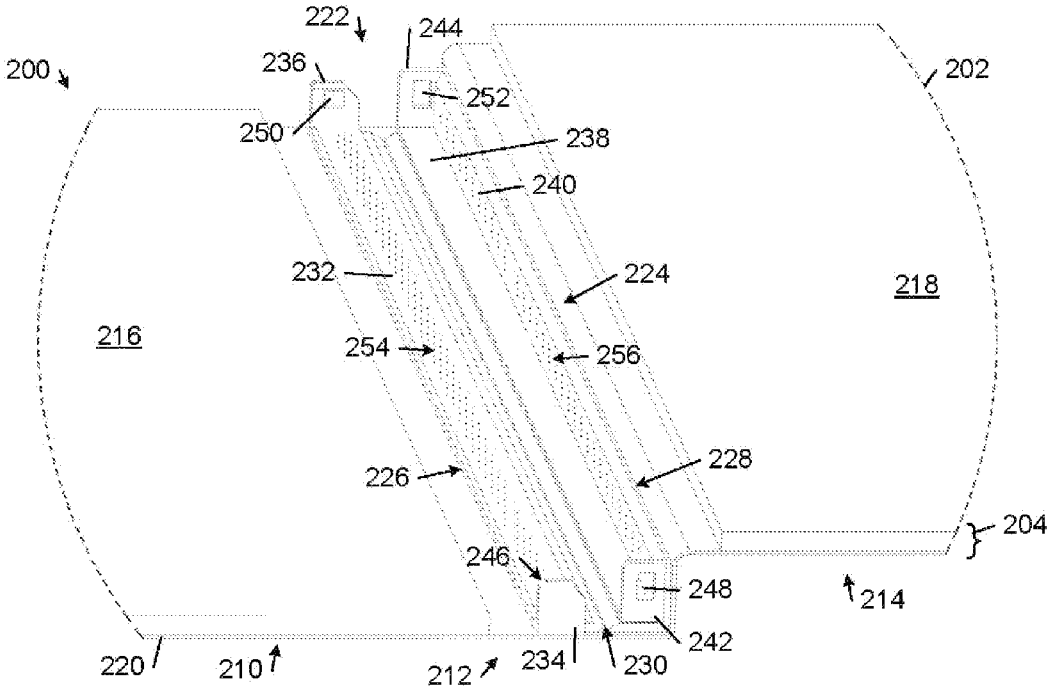
FIG. 11A is an enlarged perspective view of a region of the media binder of FIG. 10 in the open state.

FIG. 10 shows an embodiment 200 of the media binder 10 in an open state. FIG. 11A shows an enlarged view of a central region 202 of the media binder 200. The media binder 200 includes a cover 204 that has an inwardly facing side 206 an outwardly facing side 208. The cover 200 also includes a front part 210, a spine part 212, and a back part 214. The front and back parts 210, 214 of the cover 204 respectively include front and back base layers 216, 218. The front base layer 216 includes a window 219 that allows users to see an image on the first front facing one of the physical media sheets of the collection 10 after it is loaded into the media binder 200. The front and back base layers 216, 218 are attached to an outer covering 220, which is formed of a durable material (e.g., a textile). The central region of the outer covering 220 is attached to the outwardly facing surfaces of the front and back base layers 216, 218; the marginal edges of the outer covering 220 are folded over the side edges of the front and back base layers 216, 218 and attached to the inwardly facing surfaces of the front and back base layers 216, 218. The front and back base layers 216, 218 typically are formed of a rigid planar material (e.g., paperboard or a stiff polymeric material).

In the illustrated embodiment, a binding system 222 is attached to the outer covering 220 in the spine part 212 of the cover 204. The binding system 222 includes an elongated body 224 that includes a front piece 226 and a back piece 228, which are bendable about a hinge 230. The front piece 226 includes a front side wall 232, a front tail-end datum stop 234, and a front head-end datum stop 236. The back piece 228 includes a spinal side wall 238, a back side wall 240, a back tail-end datum stop 242, and a back head-end datum stop 244. The tail-end datum stops 234, 242 provide datum surfaces for registering the tail end 22 of the physical media sheet collection 10 and the head-end datum stops 236, 244 provide datum surfaces for registering the head end 20 of the physical media sheet collection 10. In this embodiment, the elongated body 224 and the datum stops 234, 236, 242, 244 may be formed of any type of rigid material, including but not limited to metal and plastic. In addition, the elongated body 224 and the datum stops 234, 236, 242, 244 may be integral parts of a single material piece or they may be discrete parts that are mechanically or adhesively attached to one another.

Figure 11B:
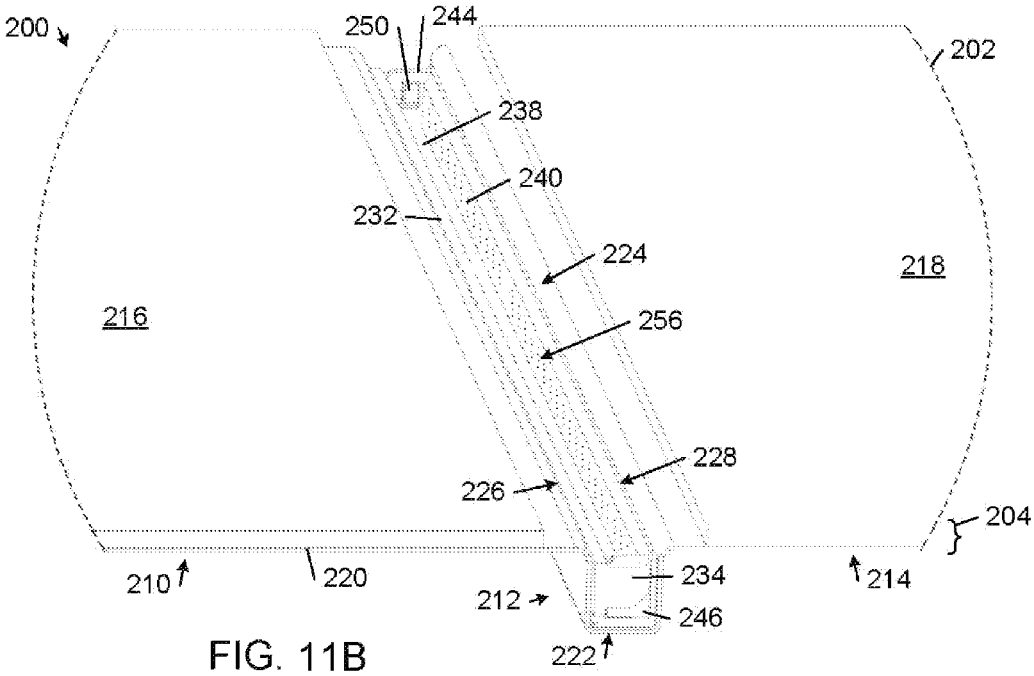
FIG. 11B is an enlarged perspective view of a region of the media binder of FIG. 10 in a closed state.

The front and back tail-end datum stops 234, 242 include interlocking engagement features 246, 248; similarly, the front and back head-end datum stops 236, 244 include interlocking engagement features 250, 252. The interlocking engagement features 246, 248 and 250, 252 hold the binding system 224 in a closed state as shown in FIG. 11B. In some embodiments, each pair of the interlocking engagement features 246, 248 and 250, 252 is implemented by a pawl and a mating slot. In other embodiments, each pair of the interlocking engagement features 246, 248 and 250, 252 is implemented by a ratchet-like features that provide an adjustable closing gap, which can accommodate a variable number of sheets (e.g., the ratchet mechanisms would close more if the collection 10 has a relatively small number of sheets and would close less if the collection 10 has a relatively large number os sheets).

Pressure sensitive adhesive 254, 256 is located on the front side wall 232 and the back side wall 240 of the binding system 222. The pressure sensitive adhesive 254, 256 is capable of binding front and back faces of the collection 10 of physical media sheets to the elongated body 224. The pressure sensitive adhesive 254, 256 typically is covered by an overlying backing before the collection 10 is loaded into the media binder 200.

Referring to FIGS. 11A and 11B, the front and back side walls 232, 240 of the elongated body 224 are bendable about the hinge 230 between the open state shown in FIG. 11A, in which the elongated body 224 presents an enlarged opening for receiving the collection 10 of physical media sheets, and the closed state shown in FIG. 11B, in which the elongated body 224 defines the trough around the spine end 18 of the collection 10.

B. Media Binder Systems that Include Planar Cover Binding Systems

Figure 12A:
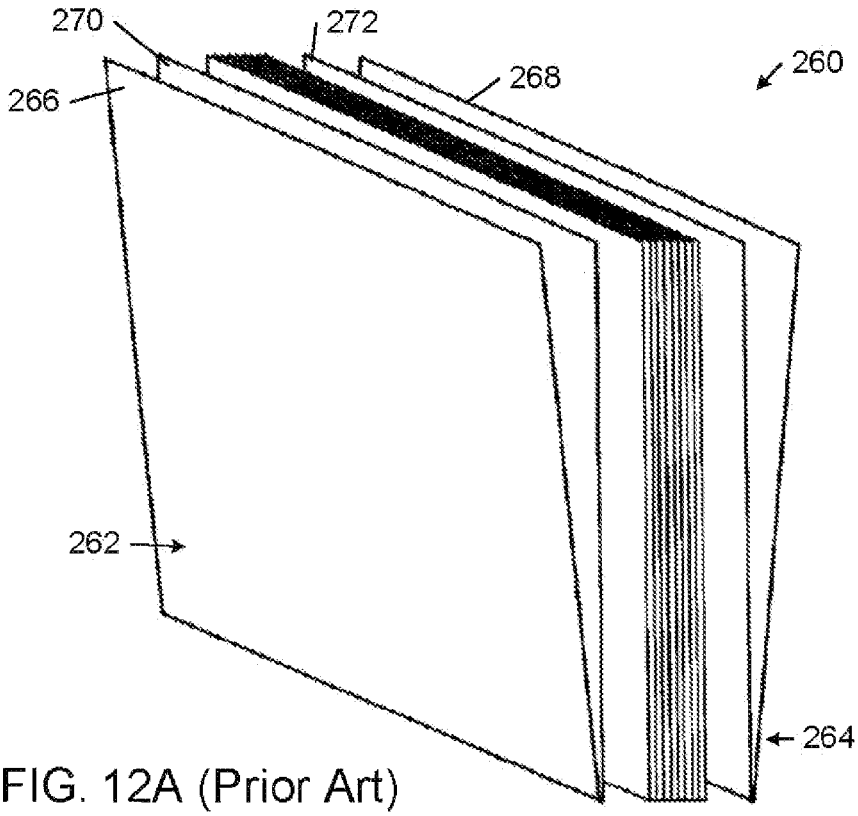
FIG. 12A (Prior Art)
FIG. 12A is a perspective view of a prior art collection of physical media sheets bounded by a pair of folded end sheets.
Figure 12B:
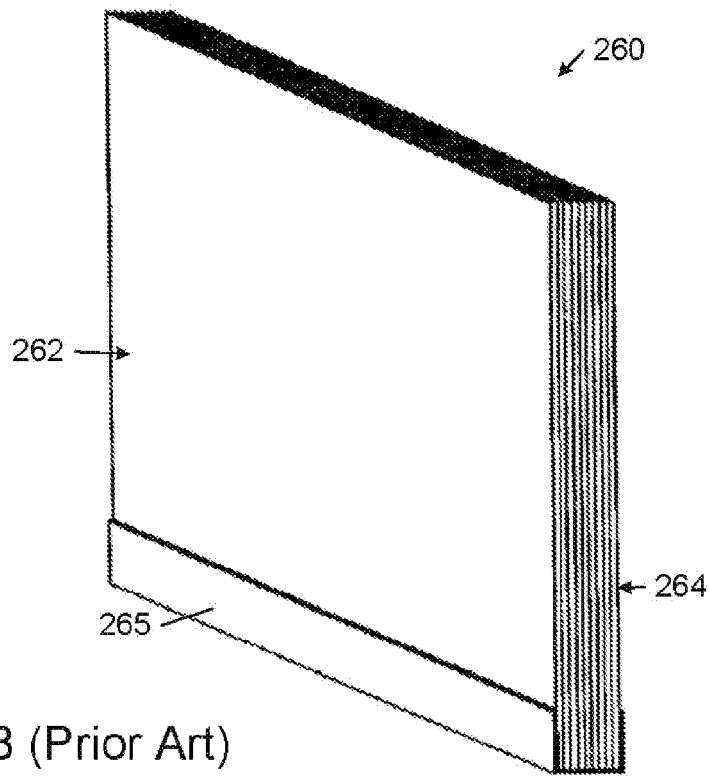
FIG. 12B (Prior Art)
FIG. 12B is a perspective view of the collection of physical media sheets of FIG. 12A after being bound by a binder strip.

Some embodiments of the media binder 12 include planar cover binding systems that are configured to form the spine of the media binder 12 about the spine end 18 of the collection 10 of physical media sheets.

a. Binding Systems Having Adhesive in Adhesive Areas of the Sides Parts of the Cover FIG. 12A shows an embodiment 260 of the collection 10 of physical media sheets that includes a pair of folded end sheets 262, 264. In general, the end sheets may be formed of any type of sheet material, including but not limited to paper and plastic. FIG. 12B shows the collection 260 of physical media sheets after being bound by a binder strip 265. In some embodiments, the binder strip 265 includes a backing material (e.g., paper, plastic, or a textile) that carries an adhesive layer (e.g., a pressure sensitive adhesive layer or a heat-activatable adhesive layer, such as a hot melt adhesive) that is capable of binding the collection 260 to the backing material and thereby form a bound book block. In other embodiments, the binder strip includes a rigid or semi-rigid backing material (e.g., plastic) that is mechanically attached to the collection 260 using a mechanical attachment mechanism (e.g., one or more staples).

Figure 13:
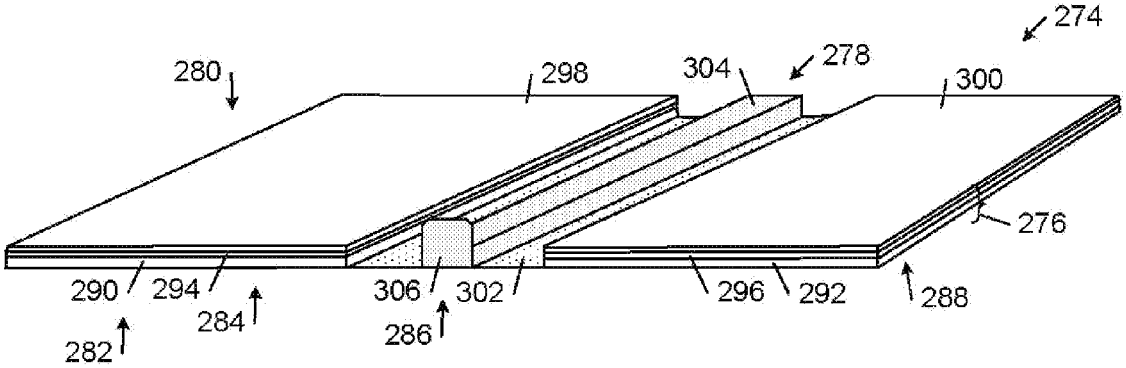
FIG. 13 is a perspective view of an embodiment of the media binder of FIG. 1 that has a datum bar that includes a spacer and the datum stop.

FIG. 13 shows an embodiment 274 of the media binder 10 that has a cover 276 and a datum bar 278.

The cover 276 has an inwardly facing side 280 and an outwardly facing side 282. The cover 276 also includes a front part 284, a spine part 286, and a back part 288. The front and back parts 284, 288 of the cover 276 respectively include front and back base layers 290, 292. Pressure sensitive adhesive 294, 296 with overlying backing layers 298, 300 are located on the front and back base layers 290, 292. The front and back base layers 290, 292 are attached to an outer covering 302, which is formed of a durable material (e.g., a textile). The central region of the outer covering 302 is attached to the outwardly facing surfaces of the front and back base layers 290, 292; the marginal edges of the outer covering 302 are folded over the side edges of the front and back base layers 290, 292 and attached to the inwardly facing surfaces of the front and back base layers 290, 292. The front and back base layers 290, 292 typically are formed of a rigid planar material (e.g., paperboard or a stiff polymeric material).

The datum bar 278 includes a spacer 304 and a datum stop 306. The spacer 304 extends in the spinal direction along the spine part 286 of the cover 276. The spacer 304 has a planar datum surface against which the spine end of the collection 260 of physical media sheets may be registered so that the fore-edge end of the sheets present a clean edge to the user.

Figure 14A:
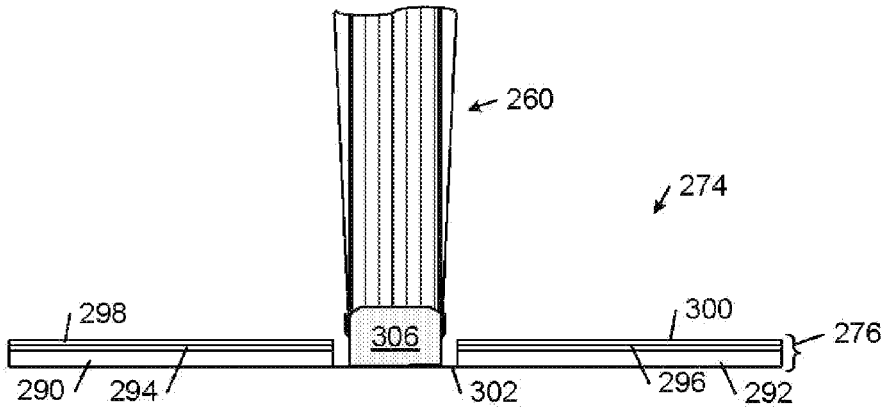
FIG. 14A is a side view of an embodiment of the media binder of FIG. 13 and the bound collection of physical media sheets registered against the datum stop and a datum surface of the spacer.
Figure 14B:
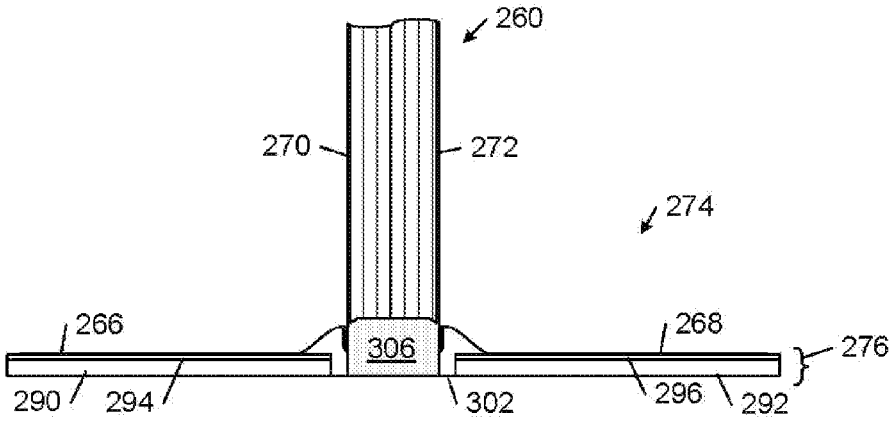
FIG. 14B is a side view of the media binder of FIG. 14A after the exposed faces of the end sheets of the bound collection of physical media sheets have been bonded to the inwardly facing sides of the front and back sides of the cover.

In operation, the bound collection 260 (FIG. 12B) of physical media sheets is registered against the datum stop 306 and the datum surface of the spacer 304, as shown in FIG. 14A. After the collection 260 has been registered and after the backing layers 298, 300 have been removed from the pressure sensitive adhesive 294, 296, the exposed outer parts 266, 268 of the end sheets 262, 264 of the collection 260 are attached to the inwardly facing sides of the front and back parts of the cover to form front and back pastedown sheets, as shown in FIG. 14B. In this embodiment, the inner parts 270, 272 of the end sheets 262, 264 of the collection 260 form the first and last pages of the bound collection of physical media sheets.

b. Binding Systems Having Adhesive in the Spine Part of the Cover

Figure 15A:
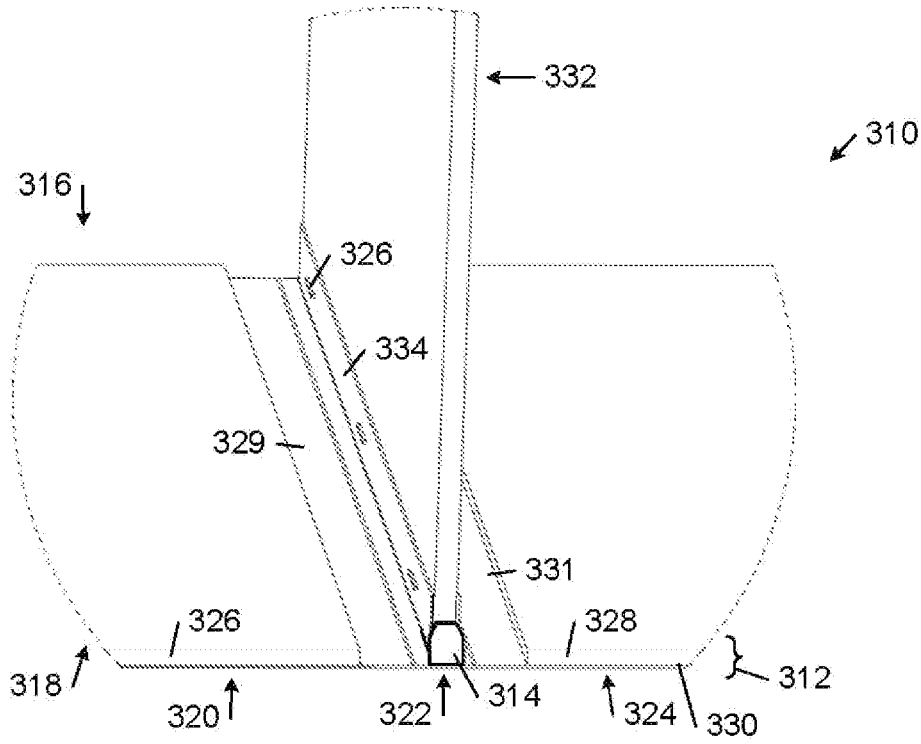
FIG. 15A is a perspective view of an embodiment of the media binder of FIG. 1 in an open state and an embodiment of a bound collection of physical media sheets registered against an embodiment of the datum stop.

FIG. 15A shows an embodiment 310 of the media binder 10 that has a cover 312 and a datum stop 314.

The cover 312 has an inwardly facing side 316 and an outwardly facing side 318. The cover 312 also includes a front part 320, a spine part 322, and a back part 324. The front and back parts 320, 324 of the cover 312 respectively include front and back base layers 326, 328. The front and back base layers 326, 328 are attached to an outer covering 330, which is formed of a durable material (e.g., a textile). The central region of the outer covering 330 is attached to the outwardly facing surfaces of the front and back base layers 326, 328; the marginal edges of the outer covering 330 are folded over the side edges of the front and back base layers 326, 328 and attached to the inwardly facing surfaces of the front and back base layers 326, 328. The front and back base layers 326, 328 typically are formed of a rigid planar material (e.g., paperboard or a stiff polymeric material).

The datum stop 314 is attached to the spine part 322 of the cover 312 either directly or indirectly through a separate spinal base layer or an integral spacer of the type described above. The spine part 322 of the cover 312 additionally includes pressure sensitive adhesive in front and back adhesive areas 329, 331. The pressure sensitive adhesive is capable of binding front and back faces of a bound collection 332 of physical media sheets to the spine part 322 of the cover 312. The pressure sensitive adhesive typically is covered by an overlying backing before the collection 332 is loaded into the media binder 310.

Figure 15B:
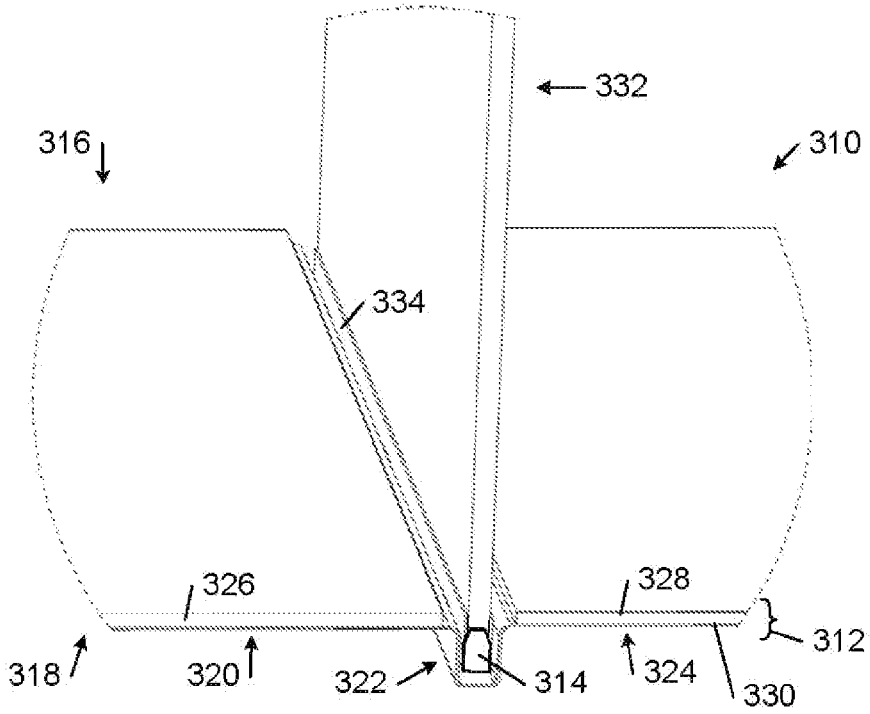
FIG. 15B is a perspective view of an embodiment of the media binder of FIG. 15A in a closed state in which the bound collection of physical media sheets is secured to the cover.

In operation, the bound collection 332 of physical media sheets is registered against the datum stop 314, as shown in FIG. 15A. The physical media sheet collection 332 may be bound, for example, using a binder strip of the type described above in connection with FIG. 12B. In the illustrated embodiment, the collection 332 is bound within a binder strip (or trough) 334 by a set of three or more staples 326. The binder strip 334 typically is designed to be tear-resistant so that the inwardly faces sides of the front and back parts 320, 324 of the cover 312 do not tear away from the collection 332 when the media binder 310 is in the open state shown in FIG. 15B. In some embodiments, the binder strip 334 includes one or more plastic material layers, at least in the outer portions of the front side of the binder trough and the back side of the binder trough that are exposed to contact the pressure sensitive adhesive on the front and back adhesive areas 329, 331 of the spine part 322 of the cover 312. In one exemplary embodiment, the binder strip 334 is a molded plastic piece that defines a rectangular trough for receiving the collection 10. In another exemplary embodiment, the binder strip 334 is formed of a paper substrate that includes one or more plasticized areas. After the collection 322 has been registered and after the backing layers have been removed from the pressure sensitive adhesive in the front and back adhesive areas 329, 331 of the spine part 322 of the cover 312, front and back sides of the binder strip 324 are attached to the front and back adhesive areas 329, 331 by the exposed pressure sensitive adhesive, as shown in FIG. 15B.

Figure 16A:
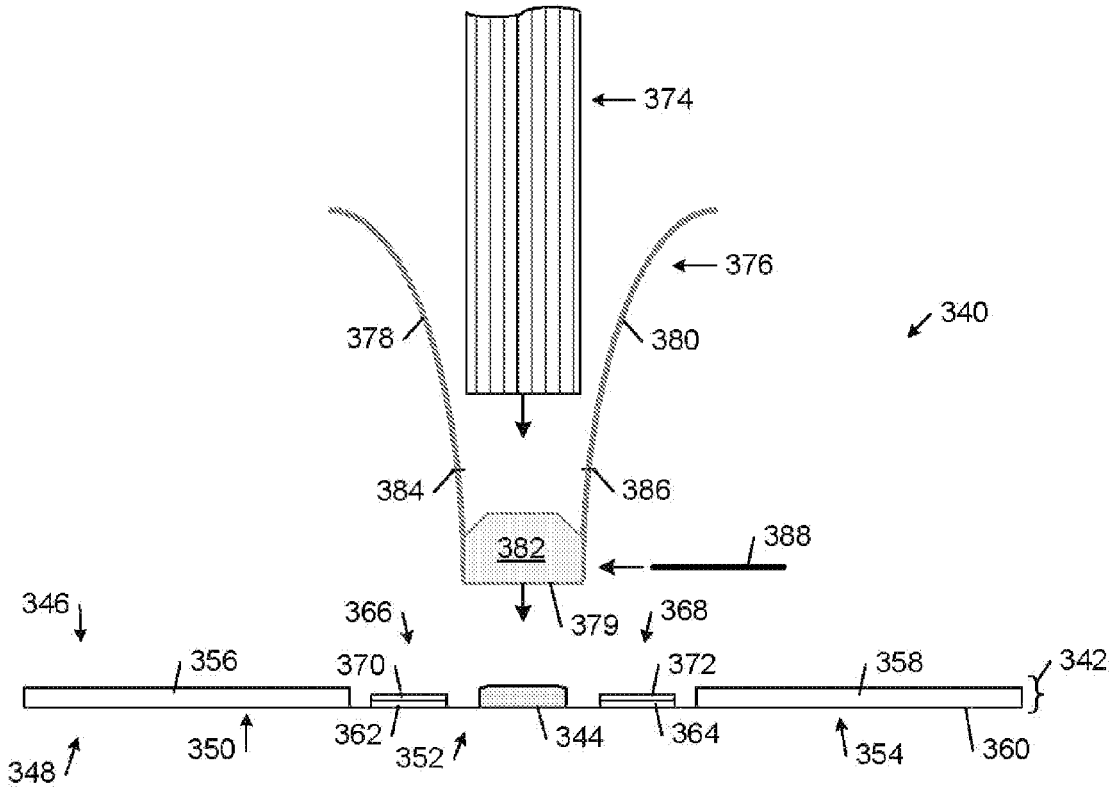
FIG. 16A is a side view of an embodiment of the media binder of FIG. 1 showing the physical media sheet collection being loaded into a binder trough and the binder trough being loaded into the media binder in registered alignment.

FIG. 16A shows an embodiment 340 of the media binder 10 that has a cover 342 and a datum stop 344.

The cover 342 has an inwardly facing side 346 and an outwardly facing side 348. The cover 342 also includes a front part 350, a spine part 352, and a back part 354. The front and back parts 350, 354 of the cover 342 respectively include front and back base layers 356, 358. The front and back base layers 356, 358 are attached to an outer covering 360, which is formed of a durable material (e.g., a textile). The central region of the outer covering 360 is attached to the outwardly facing surfaces of the front and back base layers 356, 358; the marginal edges of the outer covering 360 are folded over the side edges of the front and back base layers 356, 358 and attached to the inwardly facing surfaces of the front and back base layers 356, 358. The front and back base layers 356, 358 typically are formed of a rigid planar material (e.g., paperboard or a stiff polymeric material).

The datum stop 344 is attached to the spine part 352 of the cover 342 either directly or indirectly through a separate spinal base layer or an integral spacer of the type described above. The spine part 352 of the cover 342 additionally includes pressure sensitive adhesive 362, 364 in front and back adhesive areas 366, 368. The pressure sensitive adhesive 362, 364 typically is covered by overlying backing layers 370, 372.

In the embodiment shown in FIG. 16A, a collection 374 of physical media sheets is bound within a binder trough (or sleeve) 376 to form a book block before it is secured to the cover 342. The binder trough 376 includes a front side 378, a spine side 379, a back side 380, and a datum stop 382 located at the tail end of the binder trough 376. Each of the front and back sides 378, 380 includes a tear-line (indicated diagrammatically by the dashed lines 384, 386) that extends in a direction parallel to the spinal direction. In some embodiments, the tear-lines 384, 386 are implemented by tearable perforation lines. The collection 374 may be bound within the binder trough 376 in a wide variety of different ways, including but not limited to adhesively attaching the collection 374 to the spine side 379 of the binder trough 376, and binding the collection with a mechanical attachment mechanism, such as one or more staples (indicated diagrammatically by the line 388).

Figure 16B:
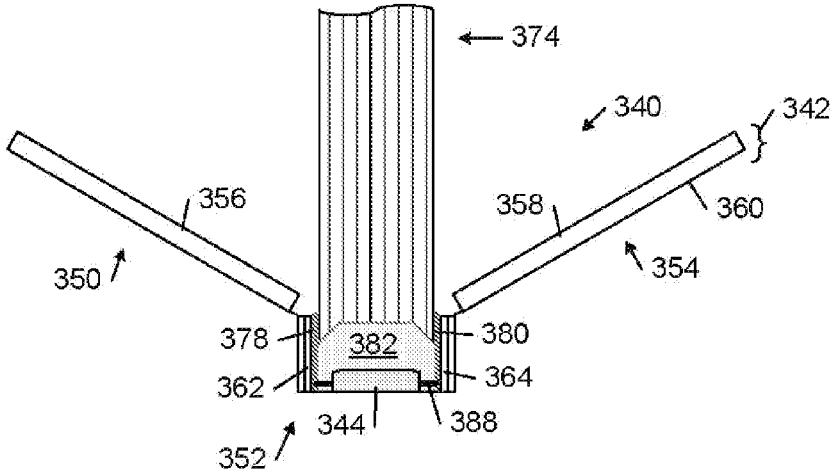
FIG. 16B is a side view of the media binder of FIG. 16A after the physical media sheet collection has been secured to the cover.

In operation, the bound collection 374 of physical media sheets is registered against the datum stop 382 of the binder trough 376 and bound to the spine side 379 of the binder trough 376. The resulting bound collection 374 is registered against the datum stop 344 of the media binder 340. After the backing layers 370, 372 have been removed from the pressure sensitive adhesive 362, 364 in the front and back adhesive areas 366, 368 of the spine part 352 of the cover 342, front and back sides of the binder trough 376 are attached to the front and back adhesive areas 366, 368. The pressure sensitive adhesive 362, 364 is capable of binding the front and back faces of the bound collection 374 of physical media sheets to the spine part 352 of the cover 342. As shown in FIG. 16B, after the collection 374 is secured to the cover 342, the fore-edge portions of the front and back sides 378, 380 of the binder trough 376 may be removed by tearing the sides 378, 380 along the tear-lines 384, 386. The binder trough 376 typically is designed to be tear-resistant so that the inwardly faces sides of the front and back parts 350, 354 of the cover 342 do not tear away from the collection 374 when the media binder 340 is in the open state. In some embodiments, the binder trough 376 includes one or more plastic material layers, at least in the outer portions of the front side of the binder trough and the back side of the binder trough that are exposed to contact the pressure sensitive adhesive on the front and back adhesive areas 366, 368 of the spine part 352 of the cover 342. In one exemplary embodiment, the binder trough 376 is a molded plastic piece that defines a rectangular trough for receiving the collection 10. In another exemplary embodiment, the binder trough 376 is formed of a paper substrate that includes one or more plasticized areas.

Figure 17A:
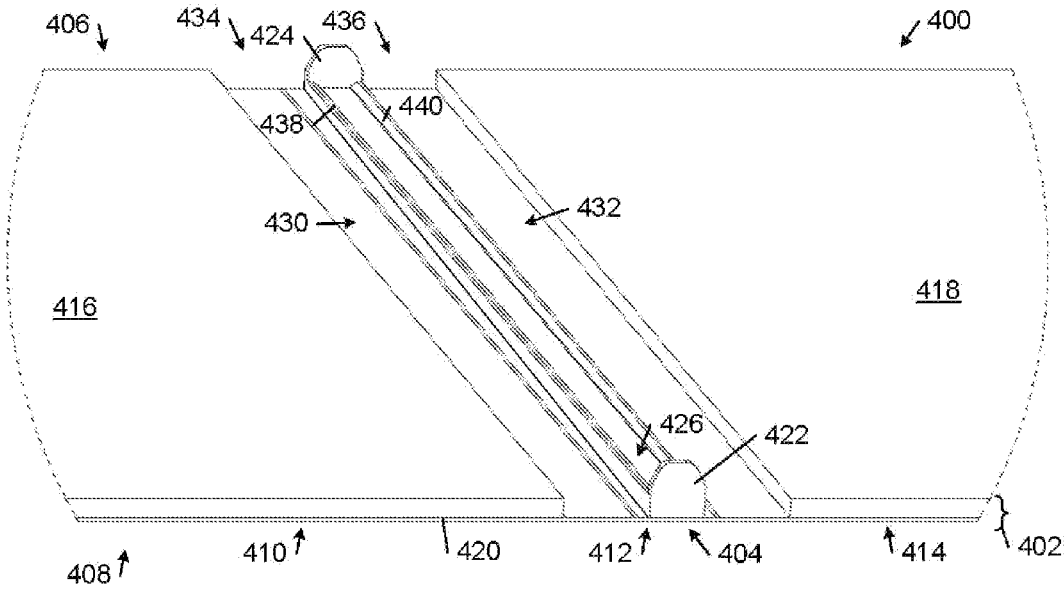
FIG. 17A is a perspective view of a portion of an embodiment of the media binder of FIG. 1 in an open state.
Figure 17B:
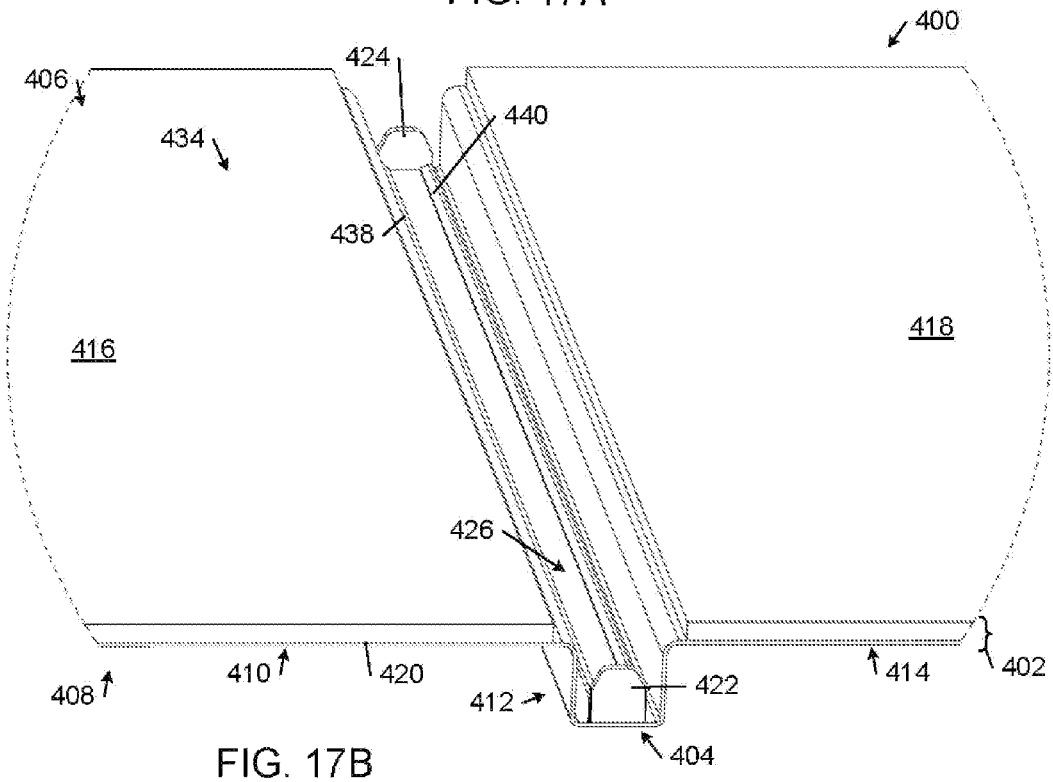
FIG. 17B is a perspective view of a portion of the media binder of FIG. 17A in a closed state.

FIG. 17A shows an embodiment 400 of the media binder 10 that has a cover 402 and a datum bar 404.

The cover 402 has an inwardly facing side 406 and an outwardly facing side 408. The cover 402 also includes a front part 410, a spine part 412, and a back part 414. The front and back parts 410, 414 of the cover 402 respectively include front and back base layers 416, 418. The front and back base layers 416, 418 are attached to an outer covering 420, which is formed of a durable material (e.g., a textile). The central region of the outer covering 420 is attached to the outwardly facing surfaces of the front and back base layers 416, 418; the marginal edges of the outer covering 420 are folded over the side edges of the front and back base layers 416, 418 and attached to the inwardly facing surfaces of the front and back base layers 416, 418. The front and back base layers 416, 418 typically are formed of a rigid planar material (e.g., paperboard or a stiff polymeric material).

The datum bar 404 includes a tail-end datum stop 422, a head-end datum stop 424, and a spacer 426. The datum stops 422, 424 and the spacer 426 typically are formed of a single piece of material (e.g., metal or plastic). In the illustrated embodiment, the datum bar 404 is formed of a single piece of a rigid material (e.g., a plastic material or a stamped piece of metal, such as aluminum). The datum bar 404 typically is attached directly to the spine part 412 of the cover 402. The spine part 412 of the cover 402 additionally includes pressure sensitive adhesive in front and back adhesive areas 430, 432. The pressure sensitive adhesive typically is covered by overlying backing layers. As shown in FIG. 17A, the spacer 426 has tapered side walls 438, 440 that define a trough for guiding the spine end of the collection 10 of physical media sheets into a receiving volume that has a shape of a frusto-triangular cylinder.

In operation, the collection 10 (FIG. 1) of physical media sheets is registered against one or both of the datum stops 422, 424 of the datum bar 404. After the backing layers have been removed from the pressure sensitive adhesive in the front and back adhesive areas 430, 432 of the spine part 412 of the cover 402, front and back faces of the collection 10 are attached to the front and back adhesive areas 434, 436 by moving the cover 402 in the closed state shown in FIG. 16B. The pressure sensitive adhesive is capable of binding the front and back faces of the collection 10 of physical media sheets to the spine part 412 of the cover 402.

IV. Conclusion

The embodiments that are described herein provide media binders that provide aesthetically pleasing binding results with an intuitive and easy-to-use binding process. These embodiments include a datum stop that provides a datum stop surface against which a collection of physical media sheets is registerable prior binding the collection within the media binder. The datum stop allows users to position and register the physical media sheet collection prior to binding without requiring a separate cumbersome alignment apparatus. In this way, these embodiments enable users to easily achieve aesthetically pleasing binding results.

Other embodiments are within the scope of the claims.

What is claimed is:

1. A media binder system, comprising:

a cover comprising an outwardly facing side and an inwardly facing side, wherein the inwardly facing side of the cover comprises a spine part that extends along a spine axis;

a binding system comprising an inwardly facing side and an outwardly facing side, wherein the outwardly facing side of the binding system is attached to the spine part of the inwardly facing side of the cover, the inwardly facing side of the binding system defines a trough that includes opposing side portions and a spinal portion that extends along the spine axis, the opposing side portions extend parallel to the spine axis from a first end of the trough to a second end of the trough opposite the first end, and the binding system is inelastically deformable such that opposing side portions of the trough are crimpable toward each other to define a crimp zone where the opposing side portions are operable to physically engage a spine end of a collection of physical media sheets and mechanically bind the collection of physical media sheets to the cover; and a datum stop integrated with the binding system, protruding orthogonally away from the spine part of the inwardly facing side of the cover, and comprising a datum stop surface in a plane that is displaced from the first end of the trough and extends higher above the inwardly facing side of the cover than the inwardly facing side of the spinal portion of the trough such that a head end or a tail end of the collection is registerable against the datum stop surface prior to binding the collection to the cover.

2. The system of claim 1, wherein the binding system comprises an elongated body defining the trough that receives the spine end of the collection of physical media sheets.

3. The system of claim 2, wherein the elongated body extends in a spinal direction along the inwardly facing side of the cover and the datum stop protrudes away from the spine part of the inwardly facing side of the cover in a direction orthogonal to the spinal direction.

4. The system of claim 2, wherein the datum stop is attached to the elongated body.

5. The system of claim 2, wherein the datum stop is a part of the elongated body.

6. The system of claim 2, wherein the elongated body is formed of an inelastically deformable material, the elongated body comprises an inner surface that defines the trough, and the elongated body further comprises terminal sides that are crimpable onto front and back faces of the collection of physical media sheets.

7. The system of claim 2, wherein the binding system comprises on the inner surface of the elongated body an adhesive that is thermally activatable to bind the collection of physical media sheets to the elongated body.

8. The system of claim 2, wherein the cover comprises a front part, a spine part, and a back part, the inwardly facing side of the front part comprises a front adhesive area adjacent a front hinge between the front part and the spine part, the inwardly facing side of the back part comprises a back adhesive area adjacent a back hinge between the back part and the spine part, and the binding system comprises on the front adhesive area and the back adhesive area pressure sensitive adhesive capable of binding the collection of physical media sheets to the front and back parts of the cover.

9. The system of claim 2, wherein the elongated body comprises a front side wall, a spinal side wall, and a back side wall that together define the trough, and the binding system comprises on the front side wall and the back side wall pressure sensitive adhesive capable of binding front and back faces of the collection of physical media sheets to the elongated body.

10. The system of claim 9, wherein at least one of the front and back side walls of the elongated body is bendable about a hinge between an open state in which the elongated body presents an enlarged opening for receiving the collection of physical media sheets and a closed state in which the elongated body defines the trough around the spine end of the collection.

11. The system of claim 10, wherein the datum stop protrudes from the elongated body and comprises an engagement feature, and the at least one bendable side wall comprises an engagement feature that mechanically interlocks with the engagement feature of the datum stop.

12. The system of claim 1, wherein the cover comprises a front part, a spine part, and a back part, and the binding system comprises pressure sensitive adhesive that has an overlying removable backing and is operable to adhere the front part of the cover to a front face of the collection, and the binding system additionally comprises pressure sensitive adhesive that has an overlying removable backing and is operable to adhere the back part of the cover to a back face of the collection.

13. The system of claim 12, further comprising a spacer that extends in a spinal direction along the spine part of the cover, wherein the datum stop protrudes in a direction orthogonal to the spacer.

14. The system of claim 13, wherein the datum stop is attached to the spacer.

15. The system of claim 13, wherein the datum stop is a part of the spacer.

16. The system of claim 13, wherein the datum stop protrudes from a region of the spine part of the cover adjacent the spacer.

17. The system of claim 13, wherein the spacer has tapered side walls that define a trough for guiding the spine end of the collection of physical media objects into a receiving volume that has a shape of a frusto-triangular cylinder.

18. The system of claim 12, wherein the binding system comprises on the front part and the back part pressure sensitive adhesive capable of binding front and back faces of the collection of physical media sheets to the front and back parts of the cover.

19. The system of claim 18, wherein the binding system additionally comprises a binder strip carrying a thermally activatable adhesive capable of binding the collection of physical media sheets into a book block.

20. The system of claim 12, wherein the inwardly facing side of the spine part comprises a front adhesive area adjacent a front hinge between the front part and the spine part, the inwardly facing side of the spine part comprises a back adhesive area adjacent a back hinge between the back part and the spine part, and the binding system comprises pressure sensitive adhesive with an overlying removable backing on the front adhesive area and pressure sensitive adhesive with an overlying removable backing on the back adhesive area, the pressure sensitive adhesive being capable of binding front and back faces of the collection of physical media sheets to the front and back adhesive areas.

21. The system of claim 20, wherein:

the binding system additionally comprises a binder trough that is elongated in a spinal direction and has a front side that overlies a portion of a front face of the collection of physical media sheets, a back side that overlies a portion of a back face of the collection of physical media sheets, and a bottom side against which the spine end of the collection of physical media sheets is registerable; and outer portions of the front side of the binder trough and the back side of the binder trough are exposed to contact the pressure sensitive adhesive on the front and back adhesive areas.

22. The system of claim 21, wherein the datum stop is part of the binder trough.

23. The system of claim 21, wherein the outer portions of the front and back sides of the binder trough respectively comprise tearable parallel perforation lines that are spaced from the spine a distance that extends at least up to outer edges of the front and back adhesive areas.

24. The system of claim 21, wherein the exposed outer portions of the front side of the binder trough and the back side of the binder trough comprise one or more plastic layers.

25. The system of claim 1, wherein the datum stop protrudes from a tail end of a spine part of the cover, and further comprising a second datum stop that protrudes from a head end of the spine part of the cover.

26. The media binder system of claim 1, wherein the datum stop surface extends higher above the inwardly facing side of the cover than the inwardly facing side of the spinal portion of the trough such that individual edges of the physical media sheets are alignable against the datum stop surface prior to binding the collection to the cover.

27. A media binder system, comprising:

a cover comprising an outwardly facing side and an inwardly facing side, wherein the inwardly facing side of the cover comprises a spine part that extends along a spine axis;

a binding system comprising an inwardly facing side and an outwardly facing side, wherein the outwardly facing side of the binding system is attached to the spine part of the inwardly facing side of the cover, the inwardly facing side of the binding system defines a trough that includes opposing side portions and a spinal portion that extends along the spine axis, and the binding system is inelastically deformable such that opposing side portions of the trough are crimpable toward each other to define a crimp zone where the opposing side portions are operable to physically engage a spine end of a collection of physical media sheets and mechanically bind the collection of physical media sheets to the cover; and a datum stop integrated with the binding system, protruding orthogonally away from the spine part of the inwardly facing side of the cover, and comprising a datum stop surface in a plane that is displaced from the crimp zone and extends higher above the inwardly facing side of the cover than the inwardly facing side of the spinal portion of the trough such that a head end or a tail end of the collection is registerable against the datum stop surface prior to binding the collection to the cover, wherein the datum stop surface extends higher above the inwardly facing side of the cover than the inwardly facing side of the spinal portion of the trough by about half a distance by which terminal ends of the of the opposing side portions of the trough extend above the inwardly facing side of the spinal portion of the trough.

* * * * *

UNITED STATES PATENT AND TRADEMARK OFFICE

CERTIFICATE OF CORRECTION

PATENT NO. : 7,823,927 B2
APPLICATION NO. : 11/758432
DATED : November 2, 2010
INVENTOR(S) : Eric Hoarau et al.

It is certified that error appears in the above-identified patent and that said Letters Patent is hereby corrected as shown below:

In column 16, line 51, in Claim 27, delete "of the of the" and insert -- of the --, therefor.

Signed and Sealed this
Twenty-second Day of March, 2011

David J. Kappos

David J. Kappos
*Director of the United States Patent and Trademark Office*